United States Patent [19]

Givati

[11] Patent Number: 4,876,771

[45] Date of Patent: Oct. 31, 1989

[54] PLASTIC CLIP PARTICULARLY USEFUL AS A CLOTHES PIN

[75] Inventor: Izhak Givati, Tel Aviv, Israel

[73] Assignee: Shakbar Investments Ltd., Tel Aviv, Israel

[21] Appl. No.: 230,089

[22] Filed: Aug. 9, 1988

[30] Foreign Application Priority Data

Sep. 3, 1987 [IL] Israel ..... 83765

[51] Int. Cl.[4] ..... D06F 53/00

[52] U.S. Cl. ..... 24/298; 24/557; 211/119.13

[58] Field of Search ..... 24/298, 300, 371, 338, 24/339, 343, 487, 489, 567, 67.5, 67.9, 557, 30.5 P, 30.5 S; 211/119.12, 119.13

[56] References Cited

U.S. PATENT DOCUMENTS

| | | | |
|---|---|---|---|
| 148,088 | 3/1874 | Reid et al. | 24/343 |
| 516,068 | 3/1894 | Van Wormer | 211/119.13 |
| 972,531 | 10/1910 | Haynes | 24/67.9 |
| 1,429,182 | 9/1922 | Ashley | 24/557 |
| 1,434,532 | 11/1922 | Davala et al. | 24/300 |
| 2,938,252 | 5/1960 | Scheemaeker | 24/67.9 |
| 3,384,935 | 5/1968 | Salvador | 24/557 |
| 3,571,861 | 3/1971 | Olson | 24/230.5 P |
| 4,170,299 | 10/1979 | Clements | 24/298 |

FOREIGN PATENT DOCUMENTS

| | | | |
|---|---|---|---|
| 0796846 | 6/1958 | United Kingdom | 24/557 |

*Primary Examiner*—Victor N. Sakran
*Attorney, Agent, or Firm*—Benjamin J. Barish

[57] ABSTRACT

A plastic clip particularly useful as a clothes pin for hanging articles of clothing on a clothes line, comprises a strip of an elastic plastic material formed with one or two openings therethrough for receiving the clothes line, and with a slot extending from each opening to an edge to define two or three jaws for gripping the article to be hung from the clothes line. The sides of each slot are formed with a zigzag configuration to define teeth on the edges of the jaws for gripping the article of clothing between them.

14 Claims, 1 Drawing Sheet

PLASTIC CLIP PARTICULARLY USEFUL AS A CLOTHES PIN

RELATED APPLICATION

This patient application is related to patent application Ser. No. 07/136,667 for now U.S. Pat. No. 4,790,680, granted Dec. 13, 1988: Fastener Structure for Files and Multi-Purpose Clip for Use Therewith.

BACKGROUND OF THE INVENTION

The present invention relates to plastic clips, and particularly to plastic clips useful as clothes pins for hanging articles on a clothes line.

The conventional clothes pin is made of wood and is formed with a pair of spaced legs which wedge the article to the clothes line. Another commonly used clothes pin includes jaws pivotally mounted on a coil spring which urges the jaws to their closed position for clamping the article on the clothes line. Both of these conventional types of clothes pins, considering the large number normally required, are relatively expensive to produce and are also relatively bulky to store.

An object of the present invention is to provide a novel plastic clip which may be produced in volume and at low cost, and which is particularly useful as a clothes pin.

BRIEF SUMMARY OF THE INVENTION

According to the present invention, there is provided a plastic clip particularly useful as a clothes pin for hanging articles of clothing on a clothes line, comprising a strip of an elastic plastic material formed with at least one opening therethrough for receiving the clothes line, and with a slot extending from the opening, for a length substantially greater than the size of the opening, to an edge of the strip to define a pair of jaws for gripping the article to be hung from the clothes line. The sides of the slot are formed with a zigzag configuration to define teeth on the edges of the jaws for gripping the article of clothing between them; and the outer faces of the plastic strip bordering the slot are roughened to define non-slip surfaces for gripping the article engaged by the jaws.

Two embodiments of the invention are described below for purposes of example. In one embodiment, there is but a single opening of circular configuration and with a single slot, to thereby define two jaws for gripping the article to be hung from the clothes line. In a second described embodiment, the plastic clip is formed with two openings spaced longitudinally of the strip, and with two slots each extending from one of the openings to a common edge of the strip, to thereby define a three-jaw clip, constituted of a middle jaw straddled by a pair of end jaws.

In the three-jaw embodiment, the outer face of the strip between the openings is also roughened to define non-slip surfaces for gripping the article. In both described embodiments, these roughened outer faces of the strip are constituted of a plurality of ribs extending substantially perpendicularly to, and on opposite sides of, the slot or slots.

Plastic clips in accordance with the foregoing features may be produced in volume and at low cost; moreover, they take very little storage space when not in use.

According to another feature of the invention, the clip further includes a hole for attaching one end of a cord for suspending the clip when detached from the clothes line. A plastic hook is receivable on the clothes line and has a hole for attaching the other end of the cord. Such an arrangement not only facilitates suspending a plurality of clips from the clothes line to enable them to be conveniently used for hanging clothes on the line, but also prevents loss of the clips should they accidentally become detached from the clothes line.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
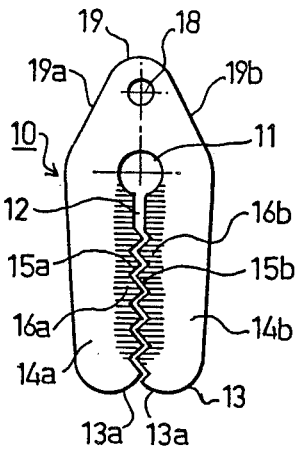
FIG. 1 is a front view illustrating a two-jaw plastic clip constructed in accordance with the present invention.

The plastic clip illustrated in FIG. 1 is generally designated 10. It is constituted of a strip of an elastic plastic material, such as polypropylene, and is formed with a circular opening 11 therethrough adjacent one edge of the strip, and with a slot 12 extending from opening 11 to the opposite edge 13 of the plastic strip. It will be seen that the length of slot 12 is substantially greater than the size of opening 11. Edge 13 is formed with rounded converging sections 13a adjacent to the respective edge of the slot 12.

Slot 12 thus divides the main portion of the plastic strip 10 into two jaws **14*a*, 14*b* which are joined at the central opening 11. Opening 11 permits one jaw to be displaced out of the plane of the other jaw, as shown in FIG. 5, in order to clamp an article of clothing S to a clothes line CL, with the clothes line passing through opening 11** of the clip.

Figure 5:
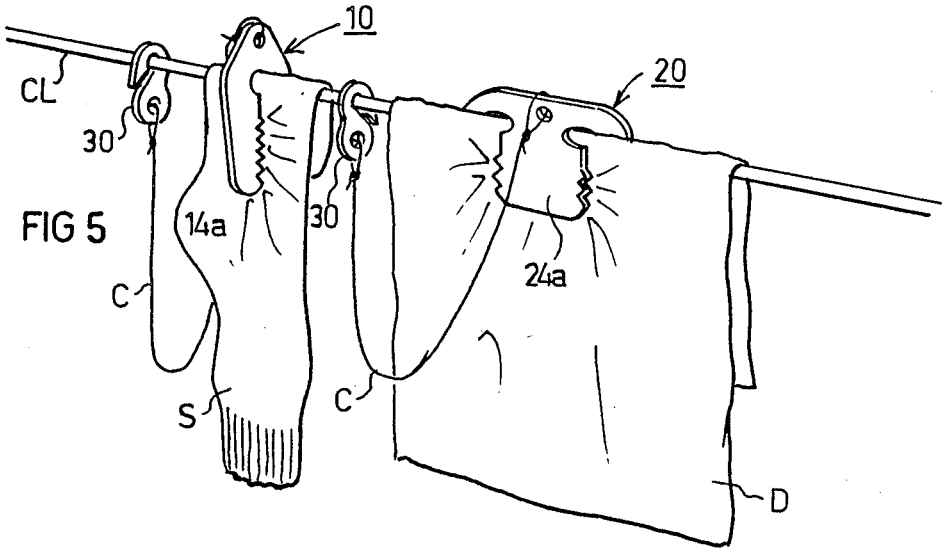
FIG. 5 illustrates the manner of using the plastic clips of FIGS. 1 and 2 and the plastic hook of FIG. 4 for hanging articles on a clothes line.

The sides of slot 12 are of zigzag configuration for most of their lengths to define teeth, as shown at **15*a* and 15*b*, on the edges of the jaws 14*a*, 14*b* for gripping the article between them when the clip is used to attach an article S to the clothes line CL, as shown in FIG. 5. In addition, the outer faces of the plastic clip 10 bordering slot 12 are roughened, as shown at 16*a* and 16*b*, to define non-slip surfaces for gripping the article engaged by the jaws 14*a*, 14*b* of the plastic clip. These roughened outer surfaces 16*a*, 16*b* are constituted of a plurality of ribs formed in the outer faces of the clip and extending substantially perpendicularly to, and on opposite sides of, slot 12**.

Plastic clip 10 illustrated in FIG. 1 is formed with a further opening 18 of smaller diameter than opening 11 and adjacent to the opposite edge 19 of the clip. Opening 18 is intended to receive a cord, indicated at C in FIG. 5, to be attached to the clothes line CL via a plastic hook 30, as will be described more particularly below with reference to FIG. 5. Edge 19 of the plastic clip 10 is also curved and is formed with tapered junctures 19a, 19b joined to the jaws 14a, 14b of the plastic clip.

Figure 2:
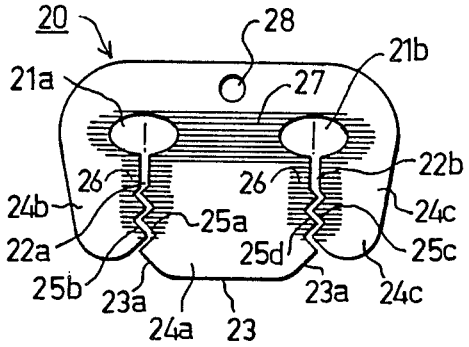
FIG. 2 is a front view illustrating a three-jaw plastic clip constructed in accordance with the present invention.

FIG. 2 illustrates a three-jaw embodiment of the invention. It is also in the form of an elastic plastic strip, generally designated 20, but has two openings 21a, 21b formed therethrough, and a slot 22a, 22b extending from each opening to a common edge 23 of the plastic strip. The two slots 22a, 22b thus define three jaws, namely a center jaw 24a straddled on opposite sides by a pair of end jaws 24b, 24c. The two slots 22a, 22b are of zigzag configuration for most of their lengths, thereby defining teeth 25a, 25b, 25c, 25d on the confronting edges of the three jaws 24a, 24b, 24c, respectively.

Openings 21a, 21b in the three-jaw embodiment of FIG. 2 are of generally elliptical configuration, rather than of circular configuration as in the embodiment of FIG. 1. This permits the center jaw 24a to be displaced further from the plane of the two end jaws 24b, 24c when attaching an article of clothing to the clothes line CL, as shown in FIG. 5.

The three-jaw clip illustrated in FIG. 2 also includes roughened surfaces on the outer faces of the strip bordering each slot 22a, 22b for gripping the article engaged by the jaws 24a, 24b, 24c. The roughened surfaces are also constituted of a plurality of ribs 26 formed at the edges of the respective jaws and extending substantially perpendicularly to, and on opposite sides of, the respective slots 22a, 22b.

The clip illustrated in FIG. 2 is formed with further roughened surfaces, as shown at 27, on its opposite sides and between the two elliptical openings 21a, 21b. These further roughened surfaces are also constituted of ribs extending parallel to ribs 26, and are effective to further grip the article engaged by the jaws of the plastic clip when fastened to the clothes line.

Figure 3:
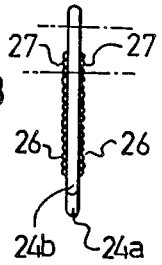
FIG. 3 is a side elevational view of the plastic clip of FIG. 2.

Clip 20 illustrated in FIG. 2 is further formed with a small opening 28, corresponding to opening 18 in clip 10 of FIG. 1, for receiving one end of a cord C of a plastic hook 30 provided on the clothes line CL. Edge 23 of clip 20 is also formed with curved surfaces 23 converging with slots 22a, 22b defining the three jaws 24a, 24b, 24c. In addition, the middle jaw 23 depends below the two end jaws, as clearly seen in FIGS. 2 and 3.

Figure 4:
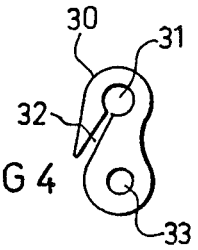
FIG. 4 is a front view illustrating a plastic hook that may be used with the plastic clip of either of FIGS. 1 or 2.

FIG. 4 illustrates the construction of plastic hook 30 used for retaining the plastic clips 10, 20 on the clothes line CL, as shown in FIG. 5. Plastic hook 30 is also of elastic plastic material. It is formed with an opening 31 for receiving the clothes line CL, a slot 32 extending from opening 31 to the outer edge for applying the hook to the clothes line, and a further opening 33 for receiving one end of cord C. The opposite end of cord C is to be attached, via hole 18 or hole 28, to the respective plastic clip 10 or 20.

FIG. 5 illustrates the manner of using the plastic clips 10 and 20, and also the plastic hook 30, when hanging clothes on a clothes line CL. Thus, the two-jaw clip 10 illustrated in FIG. 1 may be used for hanging relatively narrow articles, such as a sock S, whereas the three-jaw clip 20 illustrated in FIGS. 2 and 3 may be used for hanging relatively wider articles, such as a diaper D.

When using the two-jaw clip 10, the article to be hung is first folded over the clothes line CL, and then the clip 10 is applied by displacing one jaw (14a) slightly out of the plane of the other jaw (14b) and passing the clip along its slot 12 over the outer face of the article S until the portion of the article looped about the clothes line CL is received within opening 11 of the clip. Teeth 12a, 12b on the confronting faces of the two jaws 14a, 14b, and also the ribs 16a, 16b formed on the opposite faces of the two jaws, firmly grip the clothing article S and secure it to the clothes line CL.

When the three-jaw clip 20 illustrated in FIG. 2 is used for wider articles of clothing, illustrated by diaper D in FIG. 5, the center jaw 24a is displaced slightly out of the plane of the two end jaws 24b, 24c and is applied over the clothing article D looped over the clothes line CL. The construction wherein the lower edge 23 of the center jaw 24a extends below the lower edges of the two end jaws 24b, 24c, facilities the application of the clip to the article on the clothes line. The article is firmly gripped by the teeth 25a–25d of the three jaws 24a, 24b, 24c, and also by the ribs 26 of the three jaws, in the same manner as described above with respect to clip 10. In the three-jaw clip 20 illustrated in FIG. 2, however, additional gripping surface is provided by the ribs 27 extending between, and on opposite sides of, the two openings 21a, 21b.

The plastic hooks 30 (FIG. 4) are used for retaining both of the clips 10 and 20 on the clothes line. Thus, a hook 30 is provided for each clip 10, 20, and includes a cord C extending from opening 33 in the respective hook 30 to hole 18, 28 in the respective clip 10, 20. This retainer arrangement enables the plastic clips 10, 20 to be retained on the clothes line when the clips are not in use, and thereby obviates the need to assemble and store the plastic clips after each use. In addition, this arrangement prevents loss of the plastic clips when they are intentionally or accidentally detached from the clothes line.

While the invention has been described with respect to two preferred embodiments of the invention, it will be appreciated that many other variations, modifications and applications of the invention may be made.

What is claimed is:

1. A plastic clip particularly useful as a clothes pin for hanging articles of clothing on a clothes line, comprising: a strip of an elastic plastic material formed with at least one opening therethrough for receiving the clothes line, and with a slot extending from said opening, for a length substantially greater than the size of the opening, to an edge of said strip to define a pair of jaws for gripping the article to be hung from the clothes line; the sides of said slot being formed with a zigzag configuration to define teeth on the edges of said jaws for gripping the article of clothing between them; the outer faces of said plastic strip bordering said slot being roughened to define non-slip surfaces for gripping the article engaged by said jaws.

2. The clip according to claim 1, wherein said roughened outer faces of the plastic strip are constituted of a plurality of ribs extending substantially perpendicularly to, and on opposite sides of, said slot.

3. The clip according to claim 1, wherein said opening is of circular configuration.

4. The clip according to claim 1, wherein the plastic strip is formed with two openings therethrough spaced longitudinally of the strip, and with two slots each extending from one of said openings, for a length substantially greater than the size of the respective opening, to a common edge of the strip to thereby define a middle jaw straddled by a pair of end jaws; the outer faces of said plastic strip bordering both of said slots being roughened to define non-slip surfaces for gripping the article engaged by said jaws.

5. The clip according to claim 4, wherein the outer face of said clip between said openings, is also roughened to define non-slip surfaces for gripping the article engaged by said jaws.

6. The clip according to claim 2, wherein said roughened outer faces of the plastic strip are constituted of a plurality of ribs extending substantially perpendicularly to, and on opposite sides of, said slots and in the space between said openings.

7. The clip according to claim 4, wherein each of said openings is of elliptical configuration having the minor axis of the ellipse parallel to said slots.

8. The clip according to claim 4, wherein the middle jaw depends below the two end jaws.

9. The clip according to claim 1, further including a hole for attaching one end of a cord thereto for suspending the clip when detached from the clothes line.

10. The clip according to claim 9, further including a plastic hook receivable on the clothes line and having a hole for attaching the other end of said cord.

11. A plastic clip particularly useful as a clothes pin for hanging articles of clothing on a clothes line, comprising: a strip of an elastic plastic material formed with a single opening therethrough adjacent one edge thereof for receiving the clothes line, and with a slot extending from said opening to the opposite edge of the strip to define a pair of jaws for gripping the article to be hung from the clothes line, the sides of said slot being formed with a zigzag configuration to define teeth on the edges of said jaws for gripping the article of clothing between them; the outer faces of said plastic strip bordering said slot being roughened to define non-slip surfaces for gripping the article engaged by said jaws.

12. The clip according to claim 11, wherein said roughened outer faces of the plastic strip are constituted of a plurality of ribs extending substantially perpendicularly to, and on opposite sides of, said slot.

13. A plastic clip particularly useful as a clothes pin for hanging articles of clothing on a clothes line, comprising: a strip of an elastic plastic material formed with two openings therethrough adjacent one edge thereof for receiving the clothes line, and with a slot extending from each of said openings to the opposite edge of the strip to define a middle jaw straddled by a pair of end jaws for gripping the article to be hung from the clothes line, the sides of each of said slots being formed with a zigzag configuration to define teeth on the edges of said jaws for gripping the article of clothing between them; the outer faces of said plastic strip bordering said slots and between said openings being roughened to define non-slip surfaces for gripping the article engaged by said jaws.

14. The clip according to claim 13, wherein said roughened outer faces of the plastic strip are constituted of a plurality of ribs extending substantially perpendicularly to, and on opposite sides of, said slots and in the space between said openings.

* * * * *